US010285912B2

(12) United States Patent
Molina et al.

(10) Patent No.: US 10,285,912 B2
(45) Date of Patent: May 14, 2019

(54) BABY PACIFIER FOR A BREAST FED CHILD

(71) Applicants: Jane M. Molina, St. Louis, MO (US); Joy M. Williams, Ferguson, MO (US)

(72) Inventors: Jane M. Molina, St. Louis, MO (US); Joy M. Williams, Ferguson, MO (US)

( * ) Notice: Subject to any disclaimer, the term of this patent is extended or adjusted under 35 U.S.C. 154(b) by 0 days.

(21) Appl. No.: 15/657,485

(22) Filed: Jul. 24, 2017

(65) Prior Publication Data

US 2017/0326037 A1 Nov. 16, 2017

Related U.S. Application Data

(63) Continuation of application No. 15/185,779, filed on Jun. 17, 2016, now abandoned.

(60) Provisional application No. 62/182,137, filed on Jun. 19, 2015.

(51) Int. Cl.
*A61J 17/00* (2006.01)

(52) U.S. Cl.
CPC ..... *A61J 17/008* (2015.05); *A61J 17/001* (2015.05)

(58) Field of Classification Search
CPC ..... A61J 13/00; A61J 17/00; A61J 17/001; A61J 17/007; A61J 17/008; A61J 17/02
USPC ..... D24/194, 195, 196
See application file for complete search history.

(56) References Cited

U.S. PATENT DOCUMENTS 2,860,639 A * 11/1958 Hoover ..... A61J 17/008 606/234
3,022,915 A * 2/1962 Mullin ..... A61J 11/0065 215/11.1
4,321,927 A * 3/1982 Lynch ..... A61J 17/001 606/236
D295,073 S * 4/1988 Ford ..... D24/194
D300,462 S * 3/1989 English ..... D24/194
4,950,286 A * 8/1990 Meussdoerffer ..... A61J 17/001 606/236
5,108,686 A * 4/1992 Griffin ..... A61J 11/005 215/11.1
5,300,089 A * 4/1994 Sassin ..... A61M 31/00 606/234
5,673,806 A * 10/1997 Busnel ..... A61J 11/0065 215/11.1
D391,641 S * 3/1998 Fields ..... D24/194
5,759,195 A * 6/1998 Fields ..... A61J 17/001 606/234
5,954,749 A * 9/1999 Fields ..... A61J 17/001 606/234
D439,983 S * 4/2001 Dealing ..... D24/194
6,241,110 B1 * 6/2001 Hakim ..... A61J 11/0055 215/11.1
6,482,225 B1 * 11/2002 Bingham ..... A61M 15/00 606/234
6,736,830 B2 5/2004 Roust
D504,723 S * 5/2005 Randolph ..... D24/196
D504,724 S * 5/2005 Randolph ..... D24/196
7,789,894 B2 * 9/2010 Rohrig ..... A61M 16/0488 606/234

(Continued)

*Primary Examiner* — Ryan J. Severson
(74) *Attorney, Agent, or Firm* — Stock Legal, LLC; Dutro E. Campbell, II

(57) ABSTRACT

A pacifier that simulates the natural shape, structure and consistency of a mother's breast. The pacifier includes a teat portion with a nipple and areola attached to a mouth shield. The teat portion has a length such that it bears against the hard palate of a baby in use.

5 Claims, 3 Drawing Sheets

(56) References Cited

U.S. PATENT DOCUMENTS

D691,277 S * 10/2013 McCarty ..... D24/194
8,545,537 B2 * 10/2013 Murphy Matro ..... A61J 17/001 606/234
D700,344 S * 2/2014 Jackson-Berry ..... D24/194
8,646,632 B2 * 2/2014 Vischer ..... A61J 11/0065 128/859
9,044,379 B2 * 6/2015 Sabree ..... A61J 17/001
D734,476 S * 7/2015 Chaitanarit ..... D24/196
D748,811 S * 2/2016 Lee ..... D24/194
9,439,836 B1 * 9/2016 Thomas ..... A61J 17/00
9,463,143 B2 * 10/2016 Oates, II ..... A61J 7/0053
9,585,815 B2 * 3/2017 Tesini ..... A61J 17/001
9,662,275 B2 * 5/2017 Lee ..... A61J 11/007
D794,811 S * 8/2017 Thomas ..... D24/194
2002/0026218 A1 * 2/2002 Roust ..... A61J 17/001 606/236
2002/0030029 A1 * 3/2002 Hakim ..... A61J 11/0035 215/11.1
2004/0059381 A1 * 3/2004 Rohrig ..... A61M 16/0488 606/234
2005/0216060 A1 * 9/2005 McCarty ..... A61J 17/001 606/236
2005/0217159 A1 * 10/2005 Leung ..... A47G 1/0616 40/725
2006/0036285 A1 * 2/2006 Davis ..... A61J 17/001 606/234
2006/0201901 A1 9/2006 Sabree et al.
2008/0210655 A1 * 9/2008 Rees ..... A61J 11/006 215/11.5
2009/0005811 A1 * 1/2009 DuChesne ..... A61J 11/00 606/235
2009/0235927 A1 * 9/2009 Krueger ..... A61M 16/0488 128/200.26
2009/0248073 A1 * 10/2009 Kliegman ..... A61J 17/02 606/235
2010/0308002 A1 * 12/2010 Vischer ..... A61J 11/0065 215/11.1
2011/0054527 A1 * 3/2011 Murphy Matro ..... A61J 17/001 606/236
2011/0218569 A1 * 9/2011 Tesini ..... A61J 17/001 606/236
2014/0221917 A1 * 8/2014 Oates, II ..... A61J 7/0053 604/79
2016/0074286 A1 * 3/2016 Carter ..... A61J 17/001 606/235
2016/0090454 A1 * 3/2016 Kerns ..... A61J 11/004 604/74
2016/0293059 A1 * 10/2016 Rigert ..... A61J 11/0035
2017/0000694 A1 * 1/2017 Lee ..... A61J 11/007
2017/0224590 A1 * 8/2017 Lee ..... A61J 11/007

* cited by examiner

BABY PACIFIER FOR A BREAST FED CHILD

BACKGROUND OF THE INVENTION

1. Field of the Invention

The present invention relates to an infant pacifier that simulates the natural shape, structure and consistency of a human breast in use such that when an infant is latched onto the areola area behind the nipple the infant's lips are flanged out and the nipple makes proper contact with the hard palate.

2. Brief Description of the Prior Art

The benefits of breast feeding for an infant and for a mother are well established. It is difficult, however, for a mother to necessarily be available to satisfy all the non-nutritive sucking needs of her baby. For example, some women do at times suffer from the discomfort of having cracked and bleeding nipples. Also, for all nursing mothers, and particularly working nursing mothers, it would be highly desirable to have a pacifier that accurately simulated her breast for non-nutritive sucking while the infant and mother are separated.

Currently available pacifiers however do not satisfy the above goal. With a common pacifier, the nipple collapses under the pressure from the infant's mouth and the infant cannot bring the nipple back into its mouth and onto the soft palate. The oral motor skills that an infant uses during breast feeding are different. In nursing, the nipple is in contact with the baby's palate while the baby's tongue exerts a force on a second portion of the nipple.

It is not unusual for a baby to reject the currently available pacifiers because the infant is only familiar with the physical movements necessary for nutritive sucking. On the other hand, once a baby has accepted a pacifier, the baby may reject the mother's breasts. A nursing mother is thus presented with a dilemma yet needs relief from the non-nutritive sucking needs of her offspring.

BRIEF SUMMARY OF THE INVENTION

In view of the above, it is an object of the present invention to provide an infant pacifier that in use simulates the sucking action in nutritive feeding from a human breast. It is another object to provide a pacifier that when an infant is latched onto the areola area behind the nipple the infant's lips are flanged out and the nipple makes contact with the hard palate. It is also an object to provide a pacifier that is less likely to be rejected by a nursing baby and which is less likely to result in nipple confusion leading to breast rejection. Other objects and features of the invention will be in part apparent and in part pointed out hereinafter.

In accordance with the invention, an infant pacifier simulating the shape, structure and consistency of a human breast includes a teat portion including a nipple and areola attached to a mouth shield portion, said teat portion formed of a plastic material and having a length such that in use a distal end bears against the hard palate of a baby. Other features of the infant pacifier are disclosed below.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which an embodiment of the invention is illustrated, corresponding reference characters refer to corresponding parts throughout the several views of the drawings in which.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended t limit the scope of the disclosure, which is defined by the claims. For purposes of description herein, the terms "upper," "lower," "left," "rear," "right," "front," "vertical," "horizontal," and derivatives thereof shall relate to the invention as oriented in Drawing A. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 8:
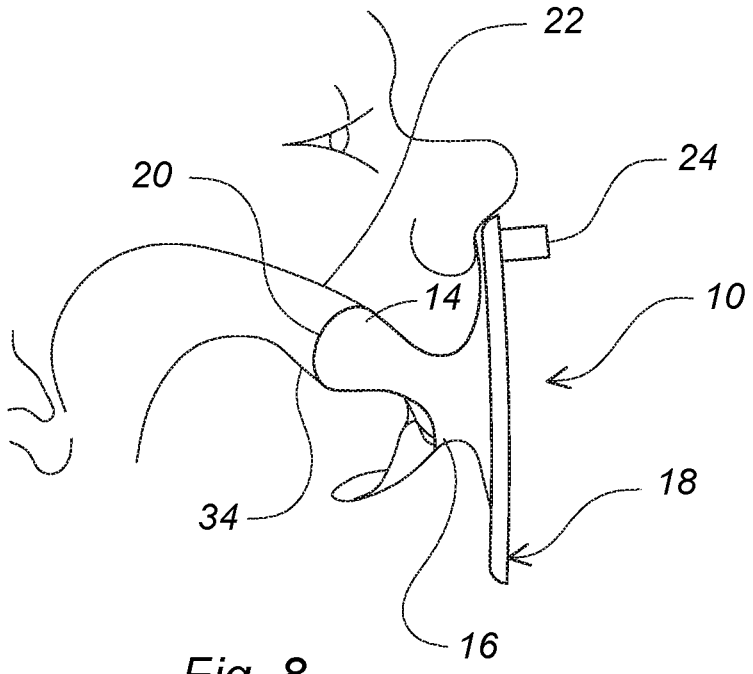
FIG. 8 is a diagram showing the pacifier in use.

Referring it drawings more particularly by reference character, a pacifier 10 in accordance with the present invention includes a teat portion 12 with a nipple 14 and an areola 16 for insertion into a baby's mouth and a mouth shield portion 18. Mouth shield portion 18 fits over the baby's face around the mouth and serves in use to limit the extent of insertion of teat portion 12 into the baby's mouth. Teat portion 12 has a length such that in use a distal end 20 as shown in FIG. 8 bears against the hard palate 22 in the roof an infant's mouth. A handle 24 is attached to mouth shield portion 18 with breathing vents 26 and an aperture 28 through which a cord maybe passed for securing pacifier 10 to a supporting surface. A safety release slit 30 may be provided in aperture 28.

Figure 1:
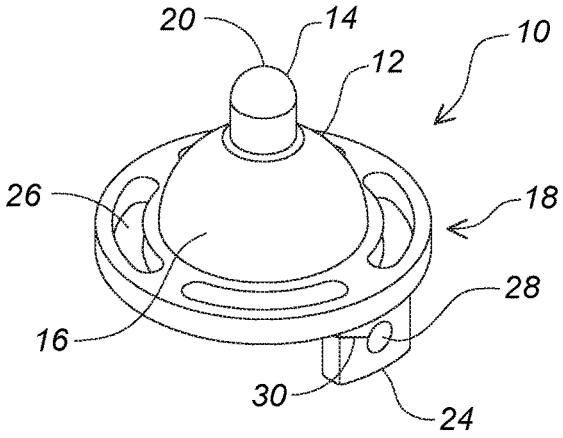
FIG. 1 is an X-ray perspective view of a pacifier in accordance with the present invention.
Figure 2:
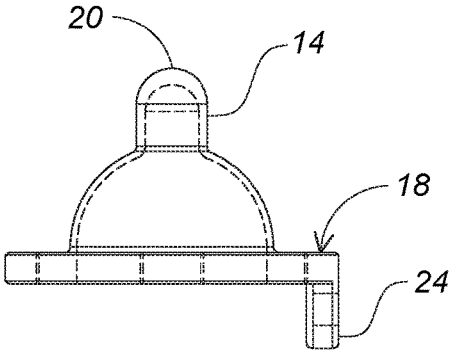
FIG. 2 is a side elevation of the pacifier.
Figure 3:
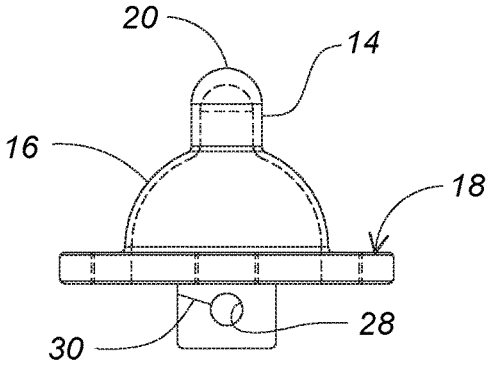
FIG. 3 is a side elevation of the pacifier rotated 90 degrees from FIG. 2.
Figure 4:
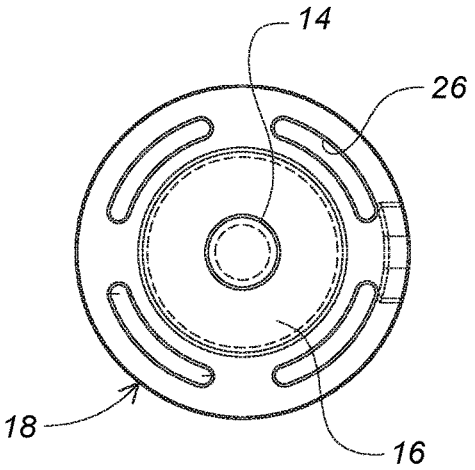
FIG. 4 is a top plan view of the pacifier.

The overall goal of pacifier 10 is to mimic the functionality, texture, shape and dimensions of a mother's areola and nipple. Specific details of an exemplary embodiment are as follows:

Nipple 14 may be formed of a silicone such as Silicone Shore A20 hardness. The nipple is the portion that the baby will roll their tongue over. As shown in FIG. 3, the wall thickness may be about 0.05".

Figure 9:
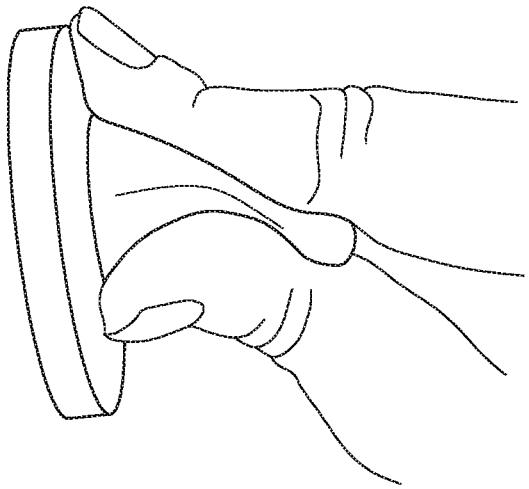
FIG. 9 is a photograph of a pacifier.

Areola 16 may be formed of the same silicone material but with a wall thickness of about 0.04" to give a more elastic feeling and stretch (as shown in FIG. 9) such that it collapses easily between the roof of the baby's mouth, gums and tongue.

Figure 5:
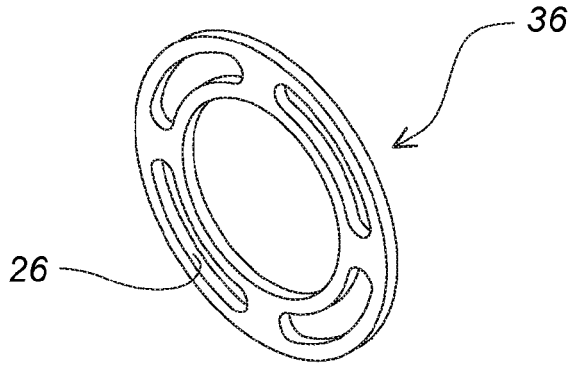
FIG. 5 is a perspective view of a base ring embedded in the pacifier.
Figure 6:
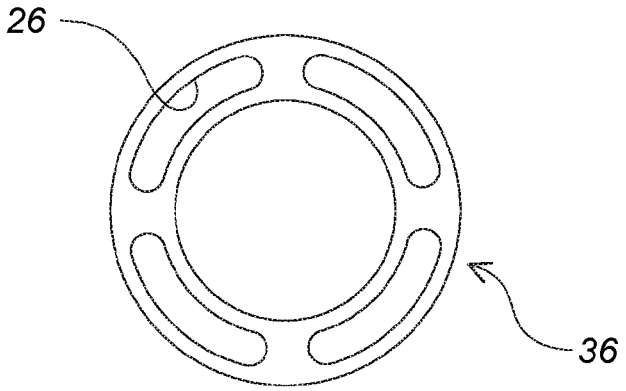
FIG. 6 is a plan view of the base ring.
Figure 7:
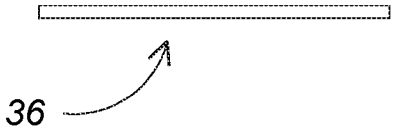
FIG. 7 is a side elevation of the base ring.

Mouth shield 18 includes an embedded base ring 36 shown in FIGS. 5-7. Base ring 36 is rigid and is formed of polycarbonate or the like.

Breathing vents 26 may be provided through mouth shield 18 and base ring 36 to allow a baby to breathe well with pacifier 10 in his or her mouth.

The handle portion 24 as seen in FIG. 3 is rectangular in shape and formed of silicone with a hole 28 and a tight slit 30 that goes from the hole to the outside of the handle—allowing a pacifier clip to slide through and attached to a baby's clothing to prevent the pacifier from falling on the floor. Slit 30 provides a cord release to prevent choking or getting the baby caught on something it needs to be released from.

The silicone used for nipple 14, areola 16 and mouth shield 18 is highly inert, does not react with most chemicals and may be molded. The polycarbonate used for base ring 36 has superior impact resistance (toughness), temperature resistance and high clarity. It can be injection molded, thermoformed or extruded. Base ring 36 is formed first and base portion 18 molded around it.

FIG. 8 illustrates pacifier 10 in use with the baby's tongue 34 making contact with one side of nipple 14 and pressing the nipple against the hard palate 22.

In the above description, numerous specific details are set forth such as examples of some embodiments, specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

What is claimed:

1. A baby pacifier for a breast fed child simulating the shape, structure and consistency of a human breast, said pacifier formed of silicone and including a teat portion including a nipple and areola attached to a mouth shield portion and configured to come into contact with a baby's lips, said teat portion having a smooth outer surface and a length such that in use a distal end bears against the hard palate of a baby, said areola having a wall thickness less than a wall thickness of the nipple such that the areola is configured to collapse between the roof of a baby's mouth, gums and tongue, and said mouth shield portion having a flexible outer layer and a rigid base ring embedded in the mouth shield portion.

2. The pacifier of claim 1 wherein the embedded base ring is formed of polycarbonate.

3. The pacifier of claim 2 wherein breathing vents are provided in the mouth shield portion and base ring.

4. The pacifier of claim 1 further comprising a handle attached to the mouth shield portion, said handle having a safety release slit for allowing a pacifier cord or clip to slide through to attach the pacifier to a baby's clothing and prevent the pacifier from falling on the floor and to provide a clip or cord release.

5. The pacifier of claim 1 wherein the wall thickness of the areola is about 0.04 inches and the wall thickness of the nipple is about 0.05 inches.

* * * * *